United States Patent [19]

Engel et al.

[11] 4,327,900

[45] May 4, 1982

[54] COOLING ELEMENT FOR A METALLURGICAL FURNACE

[75] Inventors: Arno Engel, Dortmund; Walter Laucht, Hagen; Wille Tiedtke, Dortmund, all of Fed. Rep. of Germany

[73] Assignee: Estel Hoesch Werke AG, Dortmund, Fed. Rep. of Germany

[21] Appl. No.: 184,782

[22] Filed: Sep. 8, 1980

[30] Foreign Application Priority Data

Oct. 2, 1979 [DE] Fed. Rep. of Germany ..... 2939852

[51] Int. Cl.[3] ..... C21B 7/10

[52] U.S. Cl. ..... 266/193; 266/194; 122/6 A

[58] Field of Search ..... 266/193, 194; 122/6 A, 122/6 B, 235 J, 235 D, 235 K

[56] References Cited

U.S. PATENT DOCUMENTS

| | | | |
|---|---|---|---|
| 1,904,182 | 4/1933 | Weingartner | 122/235 D |
| 3,953,008 | 4/1976 | Bashinsky et al. | 266/193 |
| 4,235,173 | 11/1980 | Sharp | 266/194 |

OTHER PUBLICATIONS

"Iron & Steel Eng'r.", Nov. 1972, pp. 98–101.

*Primary Examiner*—George O. Peters
*Attorney, Agent, or Firm*—Max Fogiel

[57] ABSTRACT

A cooling element for a metallurgical furnace in which a body of cast material has cooling tubes and adapted to face the interior or the furnace and is transversely spaced opposite marginal portions. The marginal portions of the cooling element are provided with alternating tooth-like configuration having teeth and tooth gaps between them. The cooling tubes or pipes have two inlet planes and two outlet planes. The inlet ends of the cooling pipes are alternately located in one inlet plane and in the other inlet plane and are alternately located in the one outlet plane and the second outlet plane.

10 Claims, 6 Drawing Figures

COOLING ELEMENT FOR A METALLURGICAL FURNACE

BACKGROUND OF THE INVENTION

This invention relates to a cooling element for a metallurgical furnace.

More particularly, but not exclusively, the invention relates to a cooling element for a blast furnace.

Cooling elements of various types are installed in the walls of metallurgical furnaces in order to protect the furnace walls against the deleterious influence of the heat which develops in the furnace. In recent years a type of cooling element has become more and more accepted which is known as a plate cooler or "stave cooler". A cooling element of this type has a cast iron body in which steel pipes are embedded through which the cooling medium—usually water, water vapor or a mixture of water and water vapor—is made to flow. At the major surface of the cooling element which faces the interior of the furnace the body is provided with recesses into which refractory material is inserted, for example by casting it in place or by bonding or otherwise securing it in place. This is known from German Gebrauchsmuster No. 7,331,936 and from German Pat. No. 1,925,478.

The individual cooling tubes or pipes of a cooling element are connected in known per se manner with the cooling pipes of adjacent cooling elements in such a manner that the pipe inlet connection of one cooling element and the pipe outlet connection of an adjacent cooling element are extended outwardly through the furnace wall or the furnace armor and they are connected with one another within an elbow. This connection of the cooling elements outside the furnace was heretofor considered necessary, just as it was considered necessary that adjacent cooling elements should abut one another bluntly. However, as a result of these measures there develop uncooled areas which are located in a plane immediately adjacent one another, i.e. areas in which the removal of heat due to cooling is difficult or impossible. As a result of this, further, a destruction of the cast body has been observed in the area of the junctures with adjacent bodies, particularly in the area of the horizontal junctures or adjacent cooling elements. Depending upon the extent of such damage repairs are required which often can be carried out only after the furnace is shut down. This is quite evidently a very important disadvantage.

SUMMARY OF THE INVENTION

Accordingly, it is an object of the present invention to overcome the disadvantages of the prior art.

A more particular object of the invention is to provide a cooling element for a metallurgical furnace, particularly but not exclusively for a blast furnace, which avoids the disadvantages of the prior art.

Another object of the invention is to provide a wall for a metallurgical furnace, such as a blast furnace, which also avoids the prior-art disadvantages.

A concomitant object of the invention is to improve the removal of heat particularly in the region where adjacent cooling elements abut, so as to reduce or avoid the destruction of such cooling elements and eliminate the expensive repairs which heretofor have been necessary due to damage in these areas.

Pursuant to the above objects, and others which will become apparent hereafter, oppositely located edge or marginal portions of the cooling element are provided with a tooth-like configuration having teeth and tooth gaps between them, and for the cooling tubes or pipes there are provided two inlet planes and two outlet planes. In a preferable manner two cooling pipes with their respective inlet ends are each located in one inlet plane and with their outlet ends are each located in an outlet plane. It is advantageous if the inlet ends of the cooling pipes are alternately located in the one inlet plane and in the other inlet plane and are alternately located in the one outlet plane and the second outlet plane. It is advantageous if the first inlet plane has associated with it the second outlet plane, and the first inlet and the second inlet plane has associated with it the first outlet plane.

A particularly advantageous arrangement is achieved if an inlet plane has associated with it in the region of the tooth gaps of the one side or margin of the cooling element an outlet plane in the region of the teeth of the opposite side or margin of the cooling element, and if a further inlet plane in the region of the teeth has an outlet plane associated with it in the region of the tooth gaps of the opposite side or margin of the cooling element. Generally preferred is to arrange teeth and tooth gaps in the transverse edges of the cooling element. Cooling elements according to the invention are used to erect the wall of a metallurgical oven or furnace, particularly a blast furnace, in such a manner that the inlet planes and the outlet planes of two interdigitating cooling elements form three planes of inlet ends and outlet ends of the cooling tubes.

It is advantageous if, with the cooling elements connected, the interdigitation of the teeth and tooth gaps of the connected cooling elements forms a common center plane, defined by an inlet plane of one cooling element and an outlet plane of the adjacent cooling element. In advantageous manner the inlet ends and outlet ends of the cooling tubes of adjacent cooling elements are connected outside the furnace wall by pipe elbows.

The advantages of the cooling element according to the invention are, inter alia, that the removal of heat in the region of abutting cooling elements in the furnace wall of a metallurgical furnace, such as a blast furnace, is substantially improved and accelerated, so that a destruction of the cooling elements in these regions of a furnace wall is avoided. As a result, the walls of the furnace are given a significantly increased useful life so that fewer furnace down-time incidents occur and the repair costs as a result of damage to the walls respectively the cooling elements are substantially decreased.

The invention will hereafter be described with reference to an exemplary embodiment, but it is to be understood that the embodiment illustrated in the drawing appended hereto is for explanation only and not to be considered limiting.

DESCRIPTION OF PREFERRED EMBODIMENTS

Figure 1:
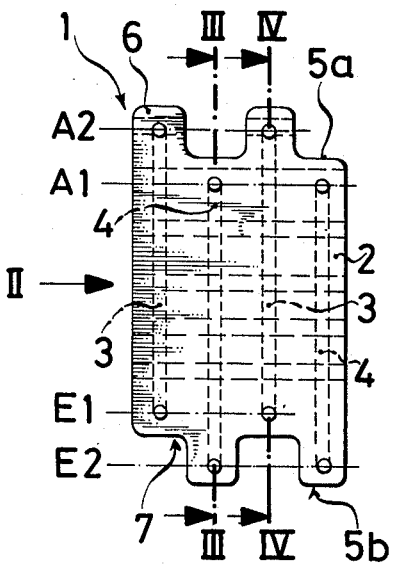
FIG. 1 is a front view showing an individual cooling element according to the present invention.
Figure 2:
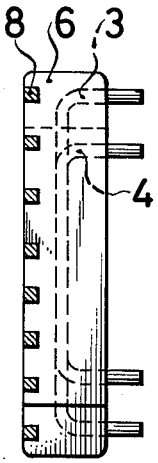
FIG. 2 is a side view of FIG. 1, looking in the direction of arrow II.
Figure 3:
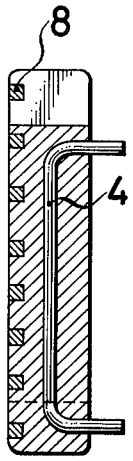
FIG. 3 is a section taken on line III—III of FIG. 1.
Figure 4:
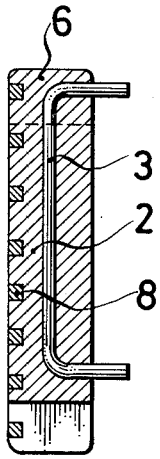
FIG. 4 is a section taken on line IV—IV of FIG. 1.

Referring firstly to FIGS. 1–4 it will be seen that the cooling element illustrated therein is identified generally with reference numeral 1 and it will be understood that it serves to cool the wall of a metallurgical oven or furnace, for example of a blast furnace. The cooling element 1 has a body 2 of cast material, i.e. as usual cast iron, in which a plurality—here four—of cooling tubes 3, 4 are embedded which are spaced from one another in longitudinal direction. The ends of the cooling tubes 3, 4 extend out of the body 2 at a major surface of the same, as shown in FIGS. 2–4 and in conventional manner the lower ends of the cooling tubes are constructed as the cooling medium inlets which then exists from the upper ends of the tubes.

It is further shown in FIGS. 1–4 that the proximal transverse edges 5 of the cooling elements 1 are each configurated in a tooth-like manner, i.e. they have teeth and tooth gaps between them. Located opposite a tooth 6 of a transverse edge or margin 5*a* is a tooth gap 7 in the opposite transverse margin 5*b*, and so on. In accordance with this configuration of the margins 5 the cooling tubes 3 begin in the region of the transverse margin 5*b* in the area of a respective gap 7 and end in the region of the transverse margin 5*a* in the area of the corresponding oppositely located tooth 6. The cooling tubes 4, on the other hand, begin in the region of the margin 5*b* in the area of the respective tooth 6 and end in the area of a gap 7 of the transverse margin 5*a*. Thus, a transverse margin 5 of a cooling element 1 according to the present invention having, as in the illustrated embodiment, four cooling tubes, there is always two cooling tubes 3 and two cooling tubes 4 which have their respective inlet ends located each in one plane identified with reference numeral E1 and E2, respectively.

In the same manner as the inlet ends of the cooling tubes 3, 4 their outlet ends are also each located in an outlet plane, which are designated in the drawing by reference characters A1 and A2, respectively. The inlet plane E1 with the inlet ends of the cooling tubes 3 has associated with it the outlet plane A2. Correspondingly, the inlet plane E2 with the inlet ends of the cooling tubes 4 has associated with it the outlet plane A1.

As shown in FIGS. 2–4, the refractory material which in the installed condition of the cooling elements faces the inner side of the furnace, is anchored in known per se manner in the recesses 8 which extend parallel to the broad side of the cooling element 1.

Figure 5:
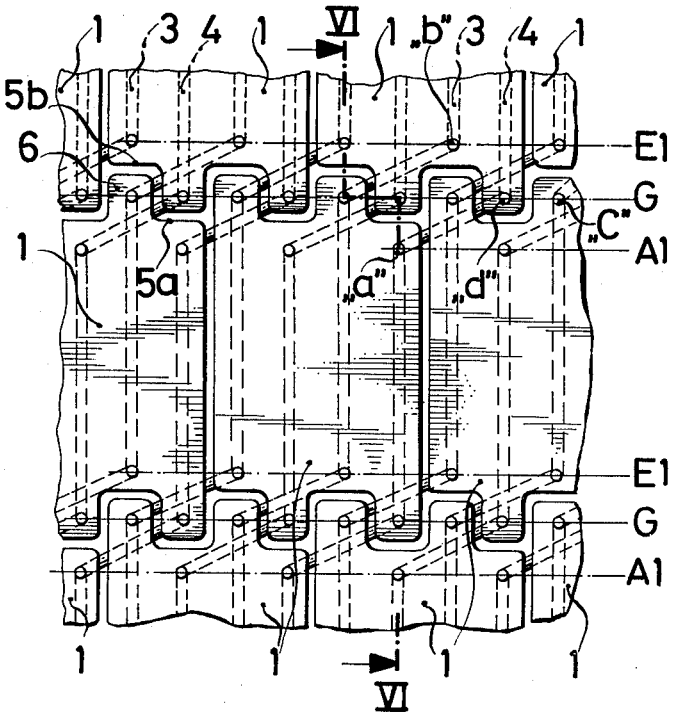
FIG. 5 is a fragmentary, somewhat diagrammatic plan view showing a detail of a blast furnace wall made up of cooling elements according to the present invention.
Figure 6:
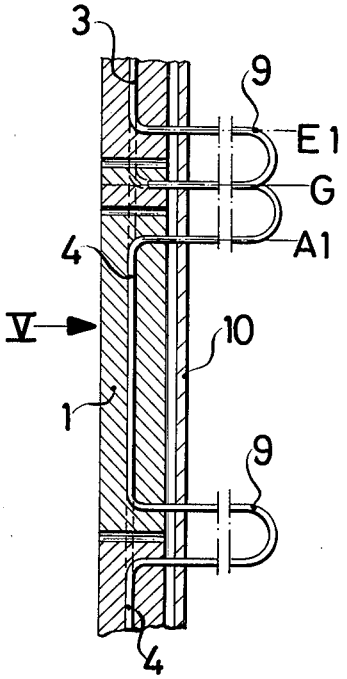
FIG. 6 is a section taken on line VI—VI of FIG. 5.

FIGS. 5 and 6 illustrate a portion of a currently preferred construction of a wall of a metallurgical furnace, in particular here of a blast furnace, which is composed of cooling elements 1 according to FIGS. 1–4. FIG. 5 shows that the outlet planes A1, A2 and the inlet planes E1 and E2 of two cooling elements 1 which abut with their transverse margins 5, form three planes with inlet and outlet ends of the cooling tubes 3, 4. In addition to the outlet plane A1 with the tube outlets "a" of the one cooling element 1 and the inlet plane E1 with the tube inlets "b" of the adjacent cooling element 1 the third plane is a common median plane G. This plane is formed by the alternately adjacent tube outlets "c" of the outlet plane A2, which alternate with the tube inlets "d" of the inlet plane E2 of an adjacent cooling element 1. It is to be noted that a tube outlet of e.g. the outlet plane A1 is not directly connected via a pipe elbow 9 with a tooth inlet of the inlet plane E1 or of the plane G; rather, the tube outlet in a tooth 1 is always connected with the tube inlet in the gap 7 of the adjacent cooling element 1. In the same manner the connection of e.g. a tube outlet "a" in the region of a gap 7 is connected with the tube inlet "d" in the tooth of the adjacent cooling element 1 via a pipe elbow 9. Thus, the inlet and outlet ends of the cooling tubes 3 of adjacent cooling elements 1 are connected, and in the same manner the outlet and inlet ends of the cooling tubes 4 of the adjacent cooling elements 1 are also connected with one another, the connection always being effected by means of pipe elbows which extend through the furnace armor 10.

The invention has hereinbefore been described with reference to an exemplary embodiment, but it is understood that various modifications will offer themselves to those skilled in the art and that all obvious modifications of this invention as specifically disclosed are intended to be encompassed within the scope of protection of the appended claims.

What is claimed is:

1. Cooling element for a metallurgical furnace, particularly for a blast furnace, comprising a body of cast material and having a major surface adapted to face the interior of the furnace and transversely spaced opposite marginal portions; steel cooling medium tubes embedded in said body; refractory material protecting said major surface and adapted to be anchored to portions of the furnace; and a plurality of alternating teeth and gaps formed in each of said marginal portions for reducing substantially wear of said marginal portions on said body, said cooling medium tubes admitting cooling medium into said body in two inlet planes and discharging the medium from the body in two outlet planes.

2. Cooling element as defined in claim 1 wherein a first pair of cooling medium tubes and a second pair of cooling medium tubes have their respective inlet ends each located in a different inlet plane and their respective outlet ends each located in a different outlet plane.

3. Cooling element as defined in claim 2, said inlet ends of the pairs of cooling medium tubes being alternately located in one of said inlet planes and the other of said inlet planes, and said outlet ends being alternately located in one of said outlet planes and in the other of said outlet planes.

4. Cooling element as defined in claim 3, wherein each higher inlet plane has associated with it a lower outlet plane, and each lower inlet plane has associated with it a higher outlet plane.

5. Cooling element as defined in claim 4, inlet plane in the region of the gaps at one marginal portion of the cooling element body is associated with an outlet plane in the region of the teeth of the opposite marginal portion, and another inlet plane in the region of the teeth of said one marginal portion is associated with another outlet plane in the region of the gaps of the other marginal portion.

6. Cooling element as defined in claim 5, wherein said marginal portions provided with said teeth and gaps are transverse marginal portions of said body.

7. A wall of a metallurgical furnace, particularly of a blast furnace, composed of cooling elements as defined in claim 1, the inlet planes and the outlet planes of any two of said cooling elements having interdigitating teeth and gaps defining three planes in which the inlet ends and outlet ends of the respective cooling tubes are located.

8. A wall of a metallurgical furnace as defined in claim 7, one of the said three planes being defined by one inlet plane of one cooling element and one inlet plane of the respectively adjacent interdigitating other cooling element.

9. A wall of a metallurgical furnace as defined in claim 8, wherein the inlet and outlet ends of the one pair of cooling tubes and the inlet and outlet ends of the other pair of cooling tubes of an adjacent cooling element are connected with one another outside of the furnace wall by pipe elbows.

10. A wall of a metallurgical furnace as defined in claim 9, wherein a tube outlet in a tooth of one cooling element is connected with a tube inlet in a gap of the respectively adjacent cooling element, and a tube outlet in a gap of one cooling element is connected with a tube inlet in a tooth of the respectively adjacent cooling element.

* * * * *